US005626471A

United States Patent [19]

Howie et al.

[11] Patent Number: 5,626,471

[45] Date of Patent: May 6, 1997

[54] ADJUSTABLE HOT GAS TORCH NOZZLE

[75] Inventors: Ian Howie; Roderic Don, both of Newark; John W. Gillespie, Hockessin, all of Del.; Scott Holmes, St. Louis, Mo.

[73] Assignee: University of Delaware, Newark, Del.

[21] Appl. No.: 240,279

[22] Filed: May 10, 1994

[51] Int. Cl.[6] ..... F23D 14/52

[52] U.S. Cl. ..... 431/251; 431/353

[58] Field of Search ..... 431/251, 344, 431/345, 346, 353, 354; 228/163; 266/53, 70, 76, 77

[56] References Cited

U.S. PATENT DOCUMENTS

| | | | |
|---|---|---|---|
| 2,089,015 | 8/1937 | Bucknam et al. | 266/76 |
| 2,472,951 | 6/1949 | Klinke | 266/76 |
| 2,747,152 | 5/1956 | Greene | 266/76 |
| 3,217,204 | 11/1965 | Nance | 266/76 |
| 3,574,506 | 4/1971 | Locke | 431/344 |
| 3,668,018 | 6/1972 | Arata et al. | 266/76 |
| 3,768,962 | 10/1973 | Baranowski, Jr. | 431/354 |
| 3,858,808 | 1/1975 | Dillon | 431/354 |
| 3,905,755 | 9/1975 | Aske . | |
| 4,157,241 | 6/1979 | Samuelson | 431/353 |
| 4,285,752 | 8/1981 | Higgins . | |
| 4,579,318 | 4/1986 | Keedy | 266/76 |
| 4,606,528 | 8/1986 | Zwicker | 266/70 |
| 4,631,023 | 12/1986 | Courrege | 431/354 |
| 4,822,444 | 4/1989 | Weingart et al. . | |
| 4,838,971 | 6/1989 | Cacak . | |
| 4,848,745 | 7/1989 | Bohannan et al. . | |
| 4,900,499 | 2/1990 | Mills . | |
| 4,915,771 | 4/1990 | O'Brien et all. . | |
| 4,938,824 | 7/1990 | Youngkeit . | |
| 4,971,846 | 11/1990 | Lundy . | |
| 4,976,812 | 12/1990 | McConnell et al. . | |
| 4,990,211 | 2/1991 | Goodfellow . | |
| 4,997,503 | 3/1991 | Bohannan et al. . | |
| 5,039,368 | 8/1991 | Gunyuzlu . | |
| 5,045,147 | 9/1991 | Benson et al. . | |
| 5,078,821 | 1/1992 | Garvey et al. . | |

FOREIGN PATENT DOCUMENTS

| | | | |
|---|---|---|---|
| 3332335 | 3/1985 | Germany | 431/344 |

*Primary Examiner*—Mathieu D. Vargot
*Attorney, Agent, or Firm*—Connolly & Hutz

[57] ABSTRACT

The invention is drawn to a nozzle device for gas torches which allows interactive, real-time control of thermoplastic processing and a method of using this device. The device consists of a movable nozzle slide that it attached to the tip of the torch. The nozzle slide can be moved in an upward or downward direction, thereby changing the amount of heat contacting the material.

19 Claims, 3 Drawing Sheets

ADJUSTABLE HOT GAS TORCH NOZZLE

The U.S. government has paid-up license in this invention and the right in limited circumstances to require the patent owner to license others on reasonable terms as provided for by the terms of Grant No. MDA 972-92-J-1026 awarded by Defense Advance Research Projects Agency.

This invention is drawn to a nozzle device for a gas torch which allows interactive, real-time control of thermoplastic composite processing and a method of using this device.

BACKGROUND OF THE INVENTION

One of the limitations up to this point in industry is that many thermoplastic parts are currently fabricated in an autoclave. There are many problems with the autoclave. The largest commercial autoclave is about 90 feet long and very expensive. The size of the part would have to be smaller than 90 feet. In addition, the autoclave takes up a lot of production floor space in a commercial production plant.

Currently industry is using a nitrogen gas torch to process thermoplastic material such as thermoplastic tape. The response time of the torch is too slow to be used to control the temperature on the surface of the thermoplastic tape. It takes several seconds to change the gas temperature in the torch. Present technology controls output of the hot gas torch by adjusting mass flow of a gas and/or its temperature. Flow controllers have very slow rates of change, and due to the high thermal mass of the torch, the temperature response time is even longer. Since it takes several seconds by changing the gas temperature in a torch, a new method and device were needed to have rapid temperature changes that could be realized by moving the torch nozzle relative to the part or the tool surface.

SUMMARY OF THE INVENTION

An object of this invention is to provide an adjustable hot gas torch nozzle for rapid heating control.

Another object of this invention is to provide a device that can be used in an industrial scale production for the manufacturing of thermoplastic materials in a small space without the use of an autoclave.

Another object of this invention is to allow a change in the effective intensity, while the torch runs at essentially full output, with a full scale change in less than 1 second.

Another object of this invention is to develop a device that is orders of magnitude faster to adjust than the conventional torch.

The device according to this invention alleviates the problems of the prior art.

Rapid temperature changes can be realized by moving the torch nozzle relative to the part or the tool surface. Upon review of the technology, it was determined that the problem could be broken down into three different areas:

1) what to move;

2) how to move it; and 3) how to control the movement.

The torch housing and accompanying cables were too heavy and bulky to move so these were eliminated from consideration as the objects to be moved. Moving the entire head would cause problems such as changing the focal point of the non-contact temperature sensor, and therefore, was also eliminated from consideration. The best course of action was to just move the nozzle on the torch.

This invention represents a low-cost option relative to lasers that produce a comparable response time (rate of change). The device of this invention allows interactive, real-time control of thermoplastic composite processing. This process uses a gas stream from a torch preferably from a nitrogen gas torch, to melt a material, preferably a polymer composite. This invention can be used in any application which uses a gas stream to melt a material, requiring rapid change in the heat input with precise control. The inventive device can be used in the fabrication of any part and of any kind of complex geometry that one can lay material onto the surface.

DETAILED DESCRIPTION OF THIS INVENTION

Figure 1:
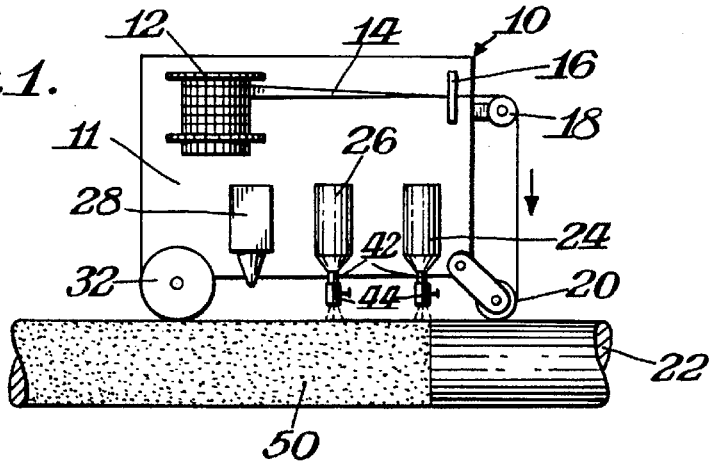
FIG. 1 is a schematic side elevational view of the processing equipment according to the invention.

FIG. 1 illustrates a side elevational view of the equipment used in the process to manufacture parts according to this invention. Device 10 consists of housing 11. The housing 11 could be made of a durable material such as, but not limited to, a metal or a plastic. A tape reel 12 could be mounted to the housing 11. The tape reel 12 could be any available commercial reel or custom fabricated unit. The tape reel 12 would be capable of containing a material or tape 14. The tape 14 could be wrapped around the reel 12. The tape 14 can be made of any meltable material, preferably a thermoplastic material, and more preferably a fiber reinforced polymer tape. This tape is commercially available from many companies such as DuPont. The tape 14 can be of any size depending upon the use. For example, the tape 14 can be about ¼ inch wide and approximately 0.007 inches thick. However, for industrial purposes, the tape can be scaled up to a much wider tape. A wider tape may be more difficult to handle. Again, the type of material or tape would depend on the application chosen.

The tape 14 could be fed through a guide plate 16. The guide plate 16 would ensure that the tape 14 is being properly fed. The guide plate 16 could be made of any available commercial material. After the tape 14 exits the guide plate 16, the tape 14 could travel around a guide roller 18. The guide roller 18 would change the direction of the tape. There could be as many guide rollers 18 as desired depending upon the ultimate direction the tape is to be routed. A guide roller 18 would be a commercially available part or custom fabricated unit. The guide roller 18 would have a cylindrical center. The ends of the cylindrical center would be of a wider width than the diameter of the tape 14. After the tape 14 exits the guide roller 18, the tape 14 could be fed underneath a laydown roller 20. The laydown roller 20 would roll the tape 14 over a mandrel 22. The mandrel 22 can be of any shape or size. The diameters can be small or large. The mandrel 22 can have a concave, convex, or flat surface or the mandrel 22 can be a combination of any of these possibilities. The mandrel 22 could have the desired shape of the product.

The tape 14 would travel to a preheater 24. The preheater 24 could be a gas torch such as, but not limited to, a nitrogen torch. The preheater 24 could preheat the tape 14. The preheating of the tape 14 could make the tape 14 soft and tacky. The tape 14 could lie on the mandrel 22 in a tacky form such that after the tape has been preheated the tape would be subjected to a torch 26, such as, but not limited to nitrogen, thereby melting the tape 14 around the mandrel 22. The preheater 24 and torch 26 are shown in more detail in FIGS. 2 through 9 and discussed in more detail below.

In the preheater 24 or the torch 26 there can be a carbon element inside of a stainless steel body. The carbon element could heat the gas up, then the hot gas stream would be allowed to impinge on the surface of the material. This is what occurs during the preheater torch. The laydown roller 20 guides the tape 14 onto the heated surface of the mandrel 22. The tape 14 forms on the surface and becomes tacky allowing it to stay in place. The second torch 26 is the main heating torch. The preheating torch 24 and the heating torch 26 can be identical, but can also serve a different purpose in the process. The heating torch 26 does not just heat the material, but actually causes the heat to go through or forces heat through the material or tape 14 that was just preheated. The heat goes into the body of the part being formed. The tape 14 would then be subjected to a non-contact temperature sensor, such as but not limited to an infrared pyrometer 28 which could be used to measure the surface temperature of the material 50 on mandrel 22. Consolidation pressure is applied by a laydown roller 32 attached to the housing 11. The compaction roller 32 would push onto the surface 50 of the mandrel or material on the mandrel material. The weight of the compaction roller 32 and/or force from a robot onto the material pushes down the material. Due to the very small contact area, it is a force over area phenomenon that consolidates the material as it exits. The part then cools and solidifies which causes the part to be fabricated. The tape 14 could be pulled off the tape reel 12 by the rotation of the mandrel 22.

This system can be used on a bare mandrel or a mandrel which already contains a material such as a tape, fiber or polymer film on its surface. Additional material can be melted on top of the first layer of material. Many different types of materials may be overlaid with each material being melted subsequently on the previous material. The mandrel 22 can also have reinforcement cords attached to the mandrel running the length of the mandrel whereby the thermoplastic material can be laid over the cords and the cords can act as a reinforcement for the material. The mandrel 22 could also be defined as, but not limited to a plate of variable geometry and surface contour which remains stationary during processing operations.

This system can be automated by hooking the system up to a robot. The robot should have at least a six-axis system depending on the needs of the user and the final product being fabricated.

Figure 2:
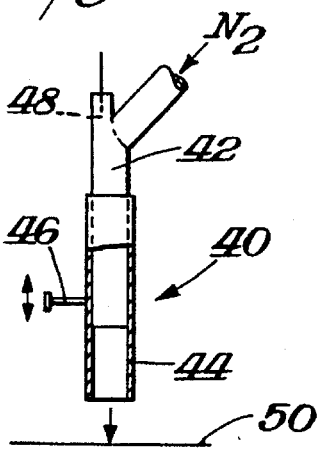
FIG. 2 is a schematic side elevational view showing a slide nozzle for a torch tip in accordance with this invention.

Rather than use an elaborate re-design, the nozzle attachment 40 is attached to the existing torch nozzle 42. FIG. 2 shows a schematic of the torch tip with the inventive torch nozzle. The torches 24 or 26 would have a torch tip 42. The nozzle attachment 40 consists of a nozzle slide 44 which can be placed on the end of the existing torch nozzle 42. The use of a high temperature dry lubricant inside nozzle slide 44 would give the low friction needed. The dry nozzle slide 44 could be made of any material so long as the melting point of the material is greater than the temperature of the heat being given off by the torch. The preferable material could be, but is not limited to, stainless steel. Attached to the nozzle slide 44 would be a pin 46 which would be capable of moving the nozzle slide 44 in an up or down direction. A thermocouple 48 would be attached to the existing nozzle. The thermocouple 48 would measure the heat or temperature of the heated gas stream inside the nozzle tube. The thermocouple 48 sends a signal back to the control box and lets the control box know what the temperature of the exiting gas stream is.

We noticed that if the end of the nozzle were lifted away from the surface, there could be a very rapid change in temperature. We did an experiment to try to get some idea of how much temperature change occurred and how quickly it occurred. We put a series of thermocouples on the surface and took several readings. The readings were entered into a computer and we were able to see in real-time the change in temperature as we incrementally changed the height of the torch. This suggested to us that we could come up with a better way to change the temperature of the gas stream at the surface. To achieve this, we attached a nozzle slide 44 on the existing torch nozzle 42 and the distance traveled was measured by the linear actuator. Depending on the temperature that is desired depends on the amount of steps programmed into the stepper motor that is used. The surface temperature is monitored with infrared pyrometers. We developed a series of models to describe the different phenomenon that were occurring in this continuous processing. The temperature readings are recorded in a controller. The data goes into the model and determines if the system is staying within these ideal processing boundaries. When this nozzle is moved back to a certain point the model determines the correct operating temperature for the speed and then it stops moving the nozzle. When the operator has overcompensated, then the model in the computer readjusts the nozzle so that the process is no longer outside the operating window. The limits of the torch outputs are limits are set up by the manufacturer of the torch. So it is all real-time interactive feedback.

Figure 3:
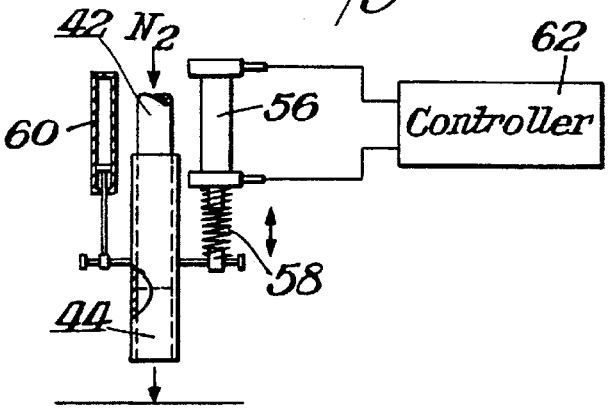
FIG. 3 is a side elevational view of a further embodiment in accordance with this invention.

FIG. 3 shows another embodiment of this invention. FIG. 3 shows the existing torch nozzle 42 having the nozzle slide 44 attached over the end of the existing torch nozzle 42. The nozzle slide 44 can be moved up and down by the use of a double-action pneumatic cylinder 56. A spring 58 could be connected to the cylinder 56 and the nozzle slide 44. Air pressure could act against the spring so that the nozzle slide 44 would stay in place. A linear variable potentiometer 60 could be calibrated and give the position of the nozzle slide 44. There could be a voltage-to-pressure or current-to-pressure controller 62 connected to the cylinder 56 to regulate the pressure to the cylinder 56. A high pressure cylinder 56 would be preferable since small variations in pressure over a large working range would not significantly effect the positioning ability of the cylinder.

Figure 4:
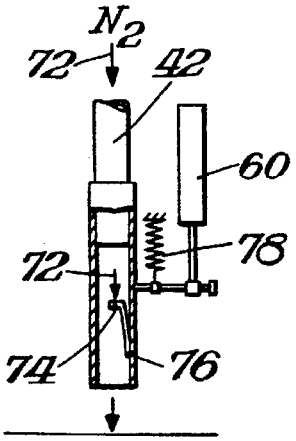
FIG. 4 is a side elevational view of a further embodiment in accordance with this invention.

FIG. 4 describes another embodiment of this invention. The flow rate of the gas 72 can be used to move the nozzle slide 76. The flow rate of the gas 72, preferably nitrogen, can be varied. The gas flow 72 would impinge on a tab 74 mounted inside the nozzle slide 76. The tab 74 can be attached in a conventional manner such as by welding or be part of the actual manufactured nozzle slide 76. The tab would be fabricated from a material that has a greater melting point than the temperature used in the torch. The nozzle slide 76 could have a low stiffness spring 78 attached to it. The position would be determined by a linear variable potentiometer 60. The nozzle slide 76 could move in an up and down direction based on the gas flow 72 impinging the tab 74.

Figure 5:
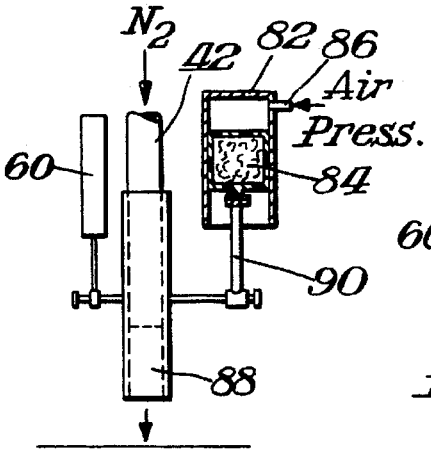
FIG. 5 is a side elevational view of a further embodiment showing a silicone pressure bag which causes the movement of the nozzle slide in accordance with this invention.

FIG. 5 illustrates another embodiment of this invention. FIG. 5 shows a silicone pressure bag. The nozzle slide 88 could be placed at the end of the torch tip 42. A piston rod 90 could be attached to the nozzle 88 and a container or cylinder 82. By varying the pressure of the container 82, filled with a silicone gel 84, the nozzle slide 88 would be able to move in an up and down direction. The silicone bag would work like a toothpaste tube and that once the pressure was released, a vacuum would be created and the silicone gel could flow back into its container 82. The container would have a valve 86 allowing the air pressure to enter the container 82. The silicone gel 84 would move via the piston rod 90. The position on the nozzle slide 88 would be determined by a linear variable potentiometer 60 and a voltage-to-pressure or current-to-pressure controller as shown in FIG. 3.

Figure 6:
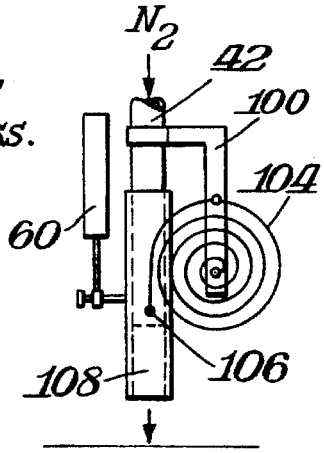
FIG. 6 is a side elevational view of a further embodiment showing a bi-metallic element which causes the movement of the nozzle slide in accordance with this invention.

FIG. 6 shows another embodiment of this invention. FIG. 6 shows a bimetal element that is used to control the position a nozzle slide 108. The nozzle slide 108 would be attached to the end of a torch tip 42. A support bracket 100 can be attached to the torch nozzle 42. A bimetal element 104 can be attached to the support bracket 100. The bimetal element 104 is commercially available or can be custom fabricated. The bimetal element 104 also can be attached to the nozzle slide 106. There could be a linear variable potentiometer 60 also attached to the nozzle slide 108. The bimetal element 104 used in a thermostat moves as the ambient temperature changes. The motion of the dement would be able to move the slide nozzle 108 in an up and down direction at the end of the torch tip 42 depending on the desired temperature. Again, positioning can be done by using a linear variable potentiometer 60 as described under the description of FIG. 3.

Figure 7:
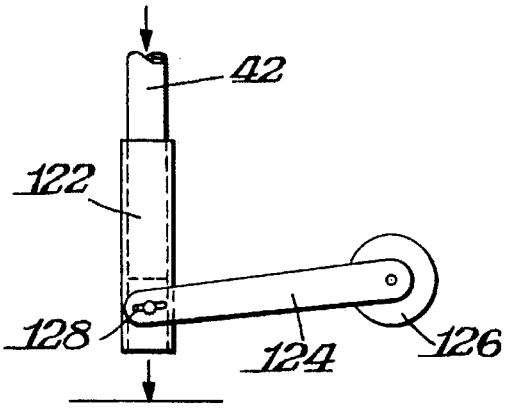
FIG. 7 is a side elevational view of a further embodiment in accordance with this invention.

FIG. 7 shows another embodiment of this invention. FIG. 7 shows a stepper motor with linkage that would move the nozzle slide in an up and down manner. The torch tip 42 would be connected to a nozzle slide 122 as discussed in the previous figures. A slide arm connector 124 would be connected to the nozzle slide 122. The slide arm connector 124 could also be connected to a stepping motor 126. There could be guide slot 128 in the slide arm connector 124 in order to prevent binding. By using the stepper motor connected 126 to the nozzle slide 122 by an arm or linkage, the position of the nozzle slide 122 can be easily determined by the number of pulses sent to the motor 126 and the corresponding change in temperature at the surface as measured by the potentiometer (not shown but is the same as described in FIG. 3 as item number 60).

Figure 8:
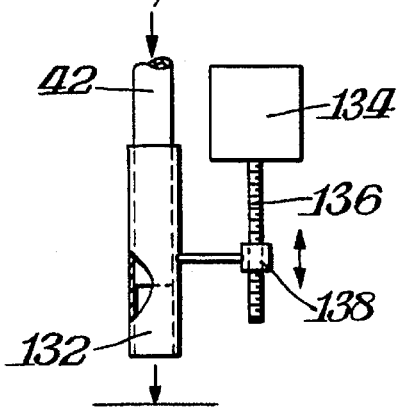
FIG. 8 is a side elevational view of a further embodiment in accordance with this invention.

Another embodiment of this invention is shown in FIG. 8. A nozzle slide 132 would be mounted to the torch tip 42 as discussed above in the previous figures. A stepping motor 134 would be connected to the nozzle slide 132 by the use of a screw 136. The screw 136 could be a threaded machine screw. The screw 136 would be fed through a screw connector 138. The stepper motor 134 can be the same or similar to the one that is described in FIG. 7. The way in which the nozzle slide 132 would move up and down would be the same way as described in FIG. 7.

Figure 9:
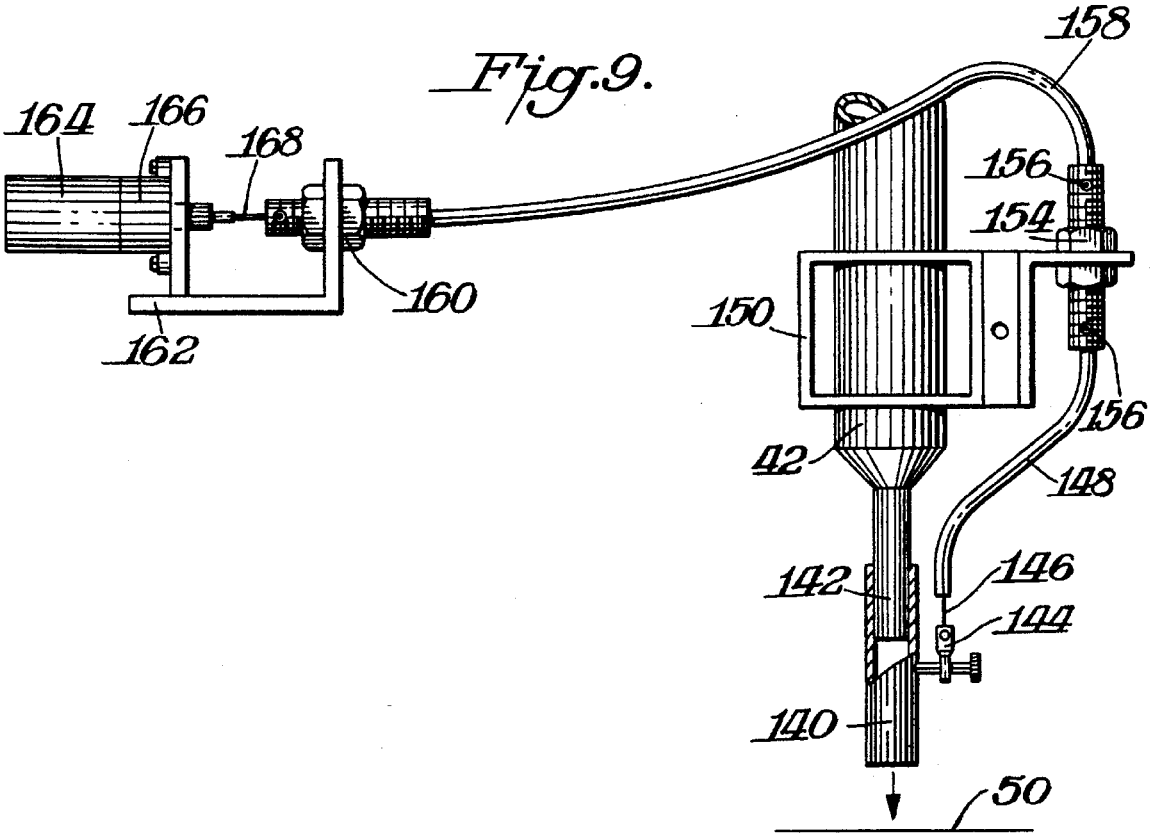
FIG. 9 is a side elevational view of a further embodiment in accordance with this invention.

Another embodiment of the invention can be shown in FIG. 9. FIG. 9 shows a stepper motor and cable which operate to move the nozzle slide in an up and down position. In FIG. 7 the nozzle slide 140 is attached to the torch tip 142 as discussed above in the previous figures. A connector 144 could be attached to the nozzle slide 140. A cable 146 which can be made of any strong commercially available material such as steel would be connected to the connector 144. There could be a tubing 148 which could cover and protect the cable 146. A torch clamp 150 could be mounted to the torch 42. A cable adjuster 154 could also be mounted to the torch damp 150. There could be a cable anchor pin or set screw 156 to make sure that the cable is anchored into the proper position. There could be another cable tension adjustor 160 connected to a remote linear adjusting device 162. The remote linear adjusting device 162 could also have a stepping motor 164 connected in said remote linear adjusting device 162. The stepping motor 164 could be the same as described in FIG. 7 and would function in the same manner. The stepping motor 164 could be connected by a gear housing 166. The actuating cable 168 would be connected to the stepping motor 164 and to the connector 144. The cable 168 could be made of any commercially available material such as, but not limited to, steel. There could be tubing 158 that would protect the cable 168. The connector 144 could also be mounted to the nozzle slide 140. The nozzle slide 140 would move in an up and down direction based upon the amount the stepper motor 164 pulls or releases on the cable.

All the previous approaches have many drawbacks such as cost, long response time or the need to mount the actuating device at the nozzle type. By using a linear actuator and a cable, the actuating device can be founded at some distance from the nozzle. This would remove some space constraint as well as making the device more flexible for the use in projects.

Figure 10:
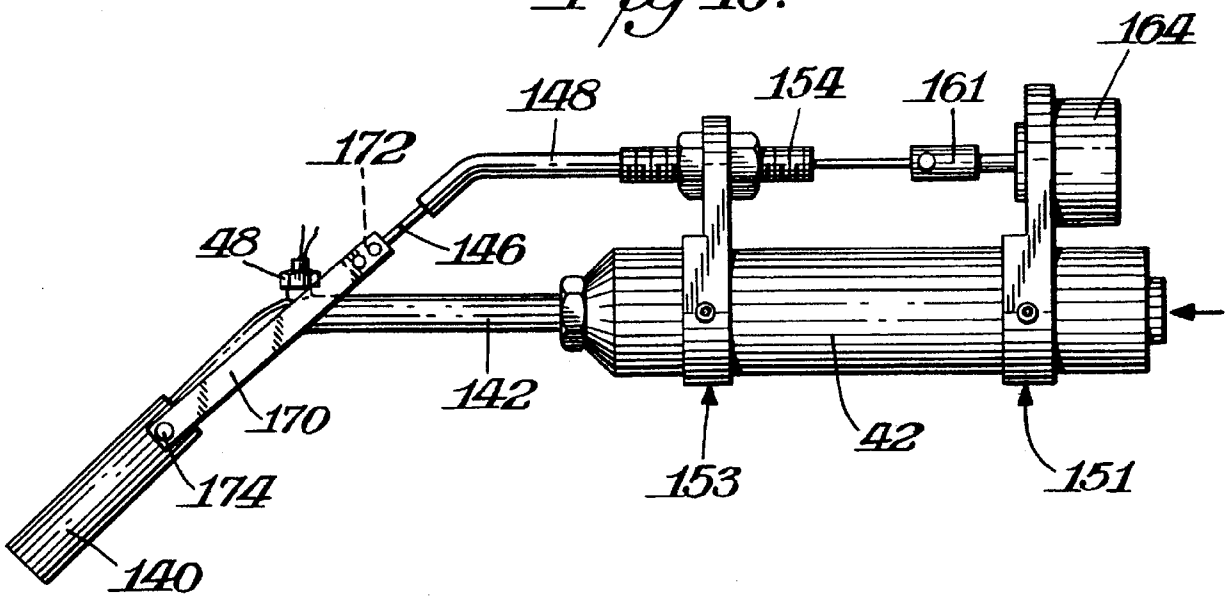
FIG. 10 is a side elevational view of a further embodiment in accordance with this invention.
Figure 11:
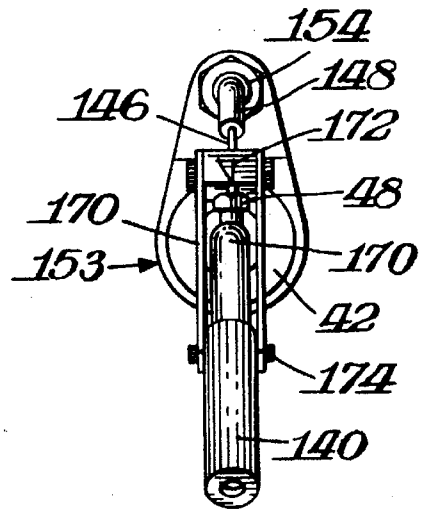
FIG. 11 is a front elevational view of the embodiment in accordance with FIG. 10.

Another embodiment of the invention is illustrated in FIGS. 10 and 11. FIG. 10 shows a side elevational view of a cable which operates to move the nozzle slide similar to the embodiment described in FIG. 9. In FIG. 10 the nozzle slide 140 is attached to the torch tip 142 as discussed in the previous figures. A thermocouple 48 could be attached to the torch tip 142. The thermocouple 48 was discussed in the previous figures. A connector arm 170 could be attached to the nozzle slide 140. The method of attachment could be by a pivotal connector pin 174 which could connect the connector arm 170 to the nozzle slide 140. A connector block 172 could be connected to the connector arm 170. The cable 146 which was described in FIG. 9 above, could be connected to the connector block 172. There could be a tubing 148 which could cover and protect cable 146. There could be an adjuster yoke assembly or bracket 153 which could be connected to a torch 42. The torch 42 was discussed in the previous figures. A cable adjuster 154 could also be connected to the yoke assembly or bracket 153. An actuator yoke assembly or bracket 151 could be mounted to the torch 42. There could be a cable connector 161 which could connect the cable 146 to the actuator yoke assembly or bracket 151. The brackets 151 and 153 can be made of a light-weight, durable material such as, but not limited to aluminum. The actuator yoke assembly or bracket 151 could be connected to a stepping motor 164. The stepping motor 164 could be the same as described in FIG. 9 and would function in the same manner. This embodiment is the preferred embodiment. This embodiment is particularly preferred over the embodiment of FIG. 9 because it is more compact, lighter, has fewer components, easier to adjust and to integrate into the equipment setup.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

What we claim:

1. A nozzle device comprising a movable nozzle slide in the form of a cylinder telescopically mounted over a torch tip, said movable nozzle slide being mounted to move in an up and down direction, and a linear variable potentiometer mounted to said nozzle slide for joint movement therewith, and said nozzle slide having a free end extending downwardly below said potentiometer, said linear variable potentiometer measures the position of the nozzle slide and said nozzle slide varies the temperature of the torch on a material which is melted by said torch by adjusting the distance of said nozzle slide to said material being melted, by moving said nozzle slide closer or further away from said material.

2. The device as claimed in claim 1, further comprising a double-action pneumatic cylinder mounted to said nozzle slide, and said double-action pneumatic cylinder being capable of moving said slide up and down.

3. The device as claimed in claim 1, further comprising a tab mounted in said nozzle slide whereby a gas stream from said torch impinges the tab causing the tab to move downward and thereby being able to adjust the slide in an up and down position.

4. The device as claimed in claim 1, further comprising a silicone gel filled container attached to said slide, and said slide is adjusted by varying the pressure in said silicon gel filled container which causes said slide to move in an up and down direction.

5. The device as claimed in claim 1, further comprising a bi-metal element mounted to said nozzle slide and connected to the end of said torch.

6. The device as claimed in claim 5, further comprising a support bracket mounted to said torch, and said bimetal element being mounted to said support bracket and mounted to said nozzle slide.

7. The device as claimed in claim 1, further comprising a stepper motor mounted to an arm which is connected to said nozzle slide, and the position of the nozzle slide is determined by the number of pulses sent to said motor.

8. The device as claimed in claim 1, further comprising a dry lubricant inside said nozzle slide.

9. The device as claimed in claim 1, further comprising a thermocouple connected to said torch tip, wherein said thermocouple measures the temperature of a heated gas stream inside said nozzle slide.

10. The device as claimed in claim 9, further comprising a computer connected to said device, whereby said computer interprets the data and measures the change in temperature depending on the height of the torch.

11. The device as claimed in claim 3, further comprising a spring connected to said cylinder, such that air pressure acts against the spring in order to keep the nozzle slide in place.

12. The device as claimed in claim 11, further comprising a voltage-to-pressure or current-to-pressure controller connected to said cylinder to regulate the pressure to said cylinder.

13. The device as claimed in claim 12, further comprising a spring attached to said nozzle slide.

14. The device as claimed in claim 4, further comprising a valve attached to said container and a piston rod attached to said nozzle slide.

15. The device as claimed in claim 7, further comprising a guide slot which is in said arm in order to prevent binding.

16. The device as claimed in claim 2, further comprising a stepper motor connected to said nozzle slide.

17. The device as claimed in claim 16, further comprising a screw that is connected to said nozzle slide and said stepper motor.

18. The device as claimed in claim 16, further comprising a cable which is attached to said nozzle slide and capable of moving the nozzle slide in an up and down position.

19. The device as claimed in claim 18, further comprising a connector arm attached to said nozzle slide and attached to said cable.

* * * * *